US007448180B1

(12) United States Patent
Coscia et al.

(10) Patent No.: US 7,448,180 B1
(45) Date of Patent: Nov. 11, 2008

(54) LOLLY COLUMN EASY FRAMER

(76) Inventors: Edward A. Coscia, 27 Jarombek Dr., Towaco, NJ (US) 07082; Ernest W. Schneck, 204 Jackson Ave., Rutherford, NJ (US) 07070

( * ) Notice: Subject to any disclaimer, the term of this patent is extended or adjusted under 35 U.S.C. 154(b) by 721 days.

(21) Appl. No.: 10/857,998

(22) Filed: Jun. 1, 2004

(51) Int. Cl.
*E04C 3/00* (2006.01)

(52) U.S. Cl. ..... 52/835; 52/845

(58) Field of Classification Search ..... 52/731.2, 52/731.3, 731.4, 732.1, 733.2, 736.3, 737.4, 52/737.5, 736.4, 738.1, 745.09, 749.1, 745.12; 138/113

See application file for complete search history.

(56) References Cited

U.S. PATENT DOCUMENTS

| | | | | | |
|---|---|---|---|---|---|
| 1,804,320 | A | | 5/1931 | Cross | |
| 3,998,028 | A | | 12/1976 | Pelletier et al. | |
| 4,467,584 | A | | 8/1984 | Crites et al. | |
| 4,484,427 | A | * | 11/1984 | Crites et al. | 52/261 |
| 4,577,449 | A | * | 3/1986 | Celli | 52/737.2 |
| 4,896,701 | A | * | 1/1990 | Young | 138/108 |
| 4,904,108 | A | * | 2/1990 | Wendel | 403/173 |
| 4,976,084 | A | | 12/1990 | Verbiar et al. | |
| 5,289,665 | A | * | 3/1994 | Higgins | 52/655.1 |
| 5,335,471 | A | | 8/1994 | Kupiec | |
| 5,553,433 | A | | 9/1996 | Lang | |
| 6,158,475 | A | * | 12/2000 | Clemmer | 138/112 |
| 2004/0020158 | A1 | * | 2/2004 | Kopshever, Sr. | 52/723.2 |

* cited by examiner

*Primary Examiner*—Richard E Chilcot, Jr.
*Assistant Examiner*—Jessica Laux
(74) *Attorney, Agent, or Firm*—Richard M. Goldberg

(57) ABSTRACT

An arrangement for framing a lolly column, includes two U-shaped framing members adapted to be wrapped and secured tightly about a lolly column. Each framing member has a U-shaped profile and includes a center member, first and second legs in parallel, spaced apart relation, and a tab extending from an end of each leg in a direction transverse to a lengthwise direction of each leg. There are also four equiangularly spaced wall members secured to outer surfaces of the framing members for securing elongated 4×4 inch wood framing members thereto such that the wood framing members extend in a direction parallel to the lolly column. Each wall member includes first and second walls forming an outwardly facing right angle therebetween and presenting outwardly facing planar surfaces to which an elongated wood framing member is adapted to be secured.

12 Claims, 7 Drawing Sheets

LOLLY COLUMN EASY FRAMER

BACKGROUND OF THE INVENTION

The present invention relates generally to lolly columns, and more particularly, is directed to an arrangement for easily framing lolly columns.

Conventionally, large rooms, such as basements and the like, include at least one lolly column for structural support. A lolly column is typically a concrete filled steel pipe column used to support a girder or other beam. When refinishing a room containing lolly columns, it is conventional to frame the lolly columns, that is, to surround the lolly columns with spaced apart, suitable size framing member, such as 2×2 inch, 2×4 inch, 2×6 inch, 4×4 inch, etc. wood framing members that extend from the floor to the ceiling, with sheet rock, paneling, etc. nailed to the wood framing members in order to provide a decorative appearance. However, this framing procedure is generally a tedious and time-consuming job.

Accordingly, various arrangements have been provided for aiding in the framing of lolly columns. U.S. Pat. No. 5,335,471 to Kupiec and U.S. Pat. No. 5,553,433 to Lang each provide a column enclosing kit for particular application to a circular column, formed by two U-shaped members or collars with part-circular inner walls for enclosing the column. The wall boards are secured directly to the flat outer surfaces of the U-shaped members. There is no disclosure of any specific corner pieces that will accept various size framing members.

U.S. Pat. No. 4,467,584 to Crites et al discloses a framing arrangement for framing columns of square cross-section only, and includes clips secured at the corners by a band encircling the square column, and to which L-shaped, corner angle, vertically oriented strips are attached to notches of the corner clips.

Other patents are also directed to framing columns of square of I-beam cross-section, namely, U.S. Pat. No. 4,976,084 to Verbiar et al, U.S. Pat. No. 4,484,427 to Crites et al and U.S. Pat. No. 3,998,028 to Pelletier et al.

However, none of these patents provide for framing a lolly column of circular cross-section, with the provision of securing various size framing members to the corners.

OBJECTS AND SUMMARY OF THE INVENTION

Accordingly, it is an object of the present invention to provide an arrangement for easily framing lolly columns that overcomes the problems with the aforementioned prior art.

It is another object of the present invention to provide an arrangement for easily framing lolly columns in which the framing members are secured around the lolly columns and include right angle walls for securing framing members thereto.

It is still another object of the present invention to provide an arrangement for easily framing lolly columns in which a framing operation can be performed quickly, efficiently and accurately.

It is a further object of the present invention to provide an arrangement for easily framing lolly columns that is easy and economical to use and manufacture.

In accordance with an aspect of the present invention, an arrangement for easily framing a lolly column, includes at least one framing member adapted to be wrapped and secured tightly about a lolly column; and a plurality of wall members secured to the at least one framing member for securing elongated framing members thereto such that the framing members extend in a direction parallel to the lolly column, each wall member including a first wall presenting an outwardly facing planar surface to which an elongated framing member is adapted to be secured.

Preferably, each wall member includes a second wall presenting an outwardly facing planar surface to which the elongated framing member is adapted to be secured, the second wall being connected with the first wall, and with the first and second walls of each wall member forming a right angle therebetween which faces outwardly. Further, each wall of the wall member includes an opening for receiving a screw therethrough for securement of a framing member thereto.

In a first embodiment, there are first and second framing members, each framing member having a generally U-shaped configuration and including a center member, first and second legs extending in the same direction from opposite ends of the center member so as to be in parallel, spaced apart relation, and a tab extending from an end of each of the first and second legs in a direction transverse to a lengthwise direction of each leg. Preferably, the tabs of the first framing member are upturned relative to the first and second legs thereof, and the tabs of the second framing member are downturned relative to the first and second legs thereof such that when the first and second framing members are positioned around a lolly column, the first legs of the first and second framing members overlap each other, the second legs of the first and second framing members overlap each other, and the tabs are positioned in relation to the wall members so as to be secured thereto in order to secure the arrangement around the lolly column. Preferably, there are four sets of first and second walls at four corners of the arrangement, equi-angularly spaced apart by 90° around the lolly column.

Further, in this first embodiment, each framing member is generally planar, and the wall members have a height substantially greater than a thickness of the planar framing members. In such case, the wall members are secured to the framing members in such a manner that the framing members substantially bisect the height of the wall members.

In a second embodiment, the framing member includes a substantially hollow, thin walled cylindrical member having a lengthwise slot extending therealong, and lengthwise extending flanges extending along facing edges of the cylindrical member on opposite sides of the lengthwise slot in facing relation to each other. Preferably, each lengthwise extending flange extends along an entire length of the cylindrical member.

There are four equi-angularly spaced wall members secured to an outer surface of the cylindrical member, each wall member including a second wall presenting an outwardly facing planar surface to which the elongated framing member is adapted to be secured, the second wall being connected with the first wall, with the first and second walls of each wall member forming a right angle therebetween which faces outwardly. Each wall of the wall member includes an opening for receiving a screw therethrough for securement of the framing member thereto. Preferably, there are four sets of first and second walls equi-angularly spaced apart by 90° around the lolly column.

Preferably, the wall members each extend along an entire length of the cylindrical member.

The above and other objects, features and advantages of the invention will become readily apparent from the following detailed description thereof which is to be read in connection with the accompanying drawings.

DETAILED DESCRIPTION

Figure 1:
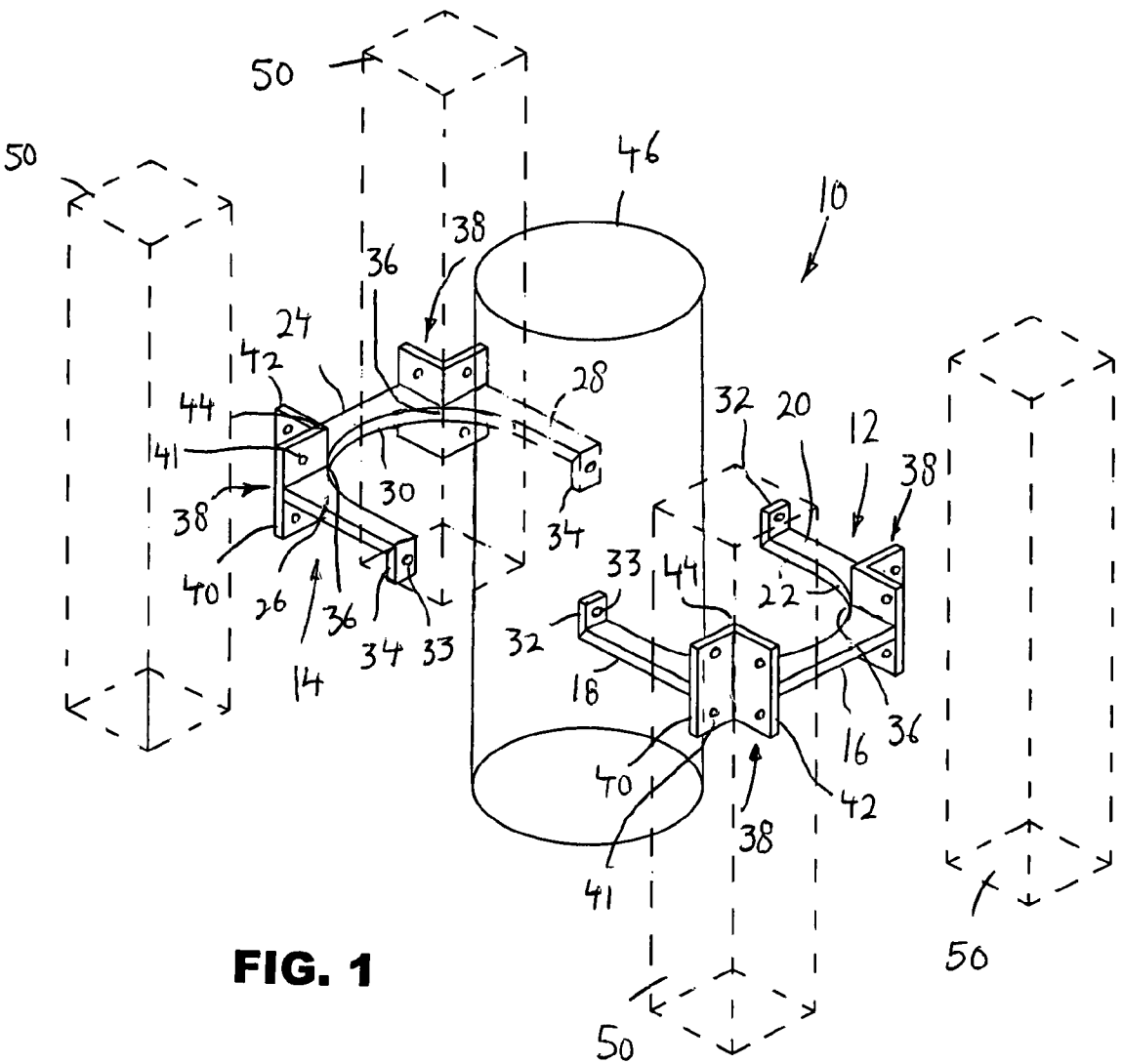
FIG. 1 is an exploded perspective view of an arrangement for easily framing lolly columns according to a first embodiment of the present invention, with the 4×4 inch wood framing members shown in phantom.
Figure 2:
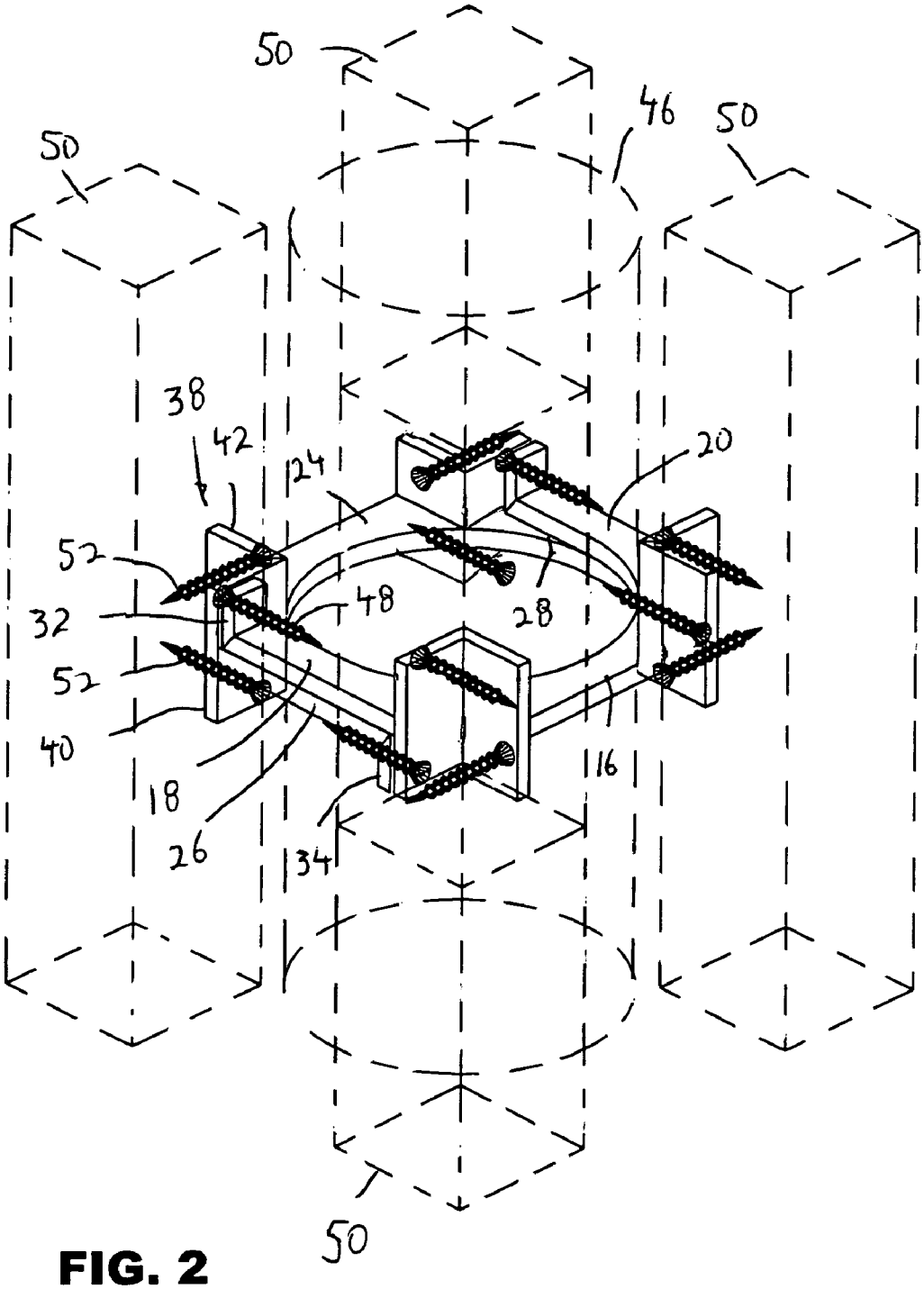
FIG. 2 is a perspective view of the arrangement of FIG. 1, shown in an assembled condition around a lolly column, with the 4×4 inch wood framing members and the lolly column shown in phantom.
Figure 3:
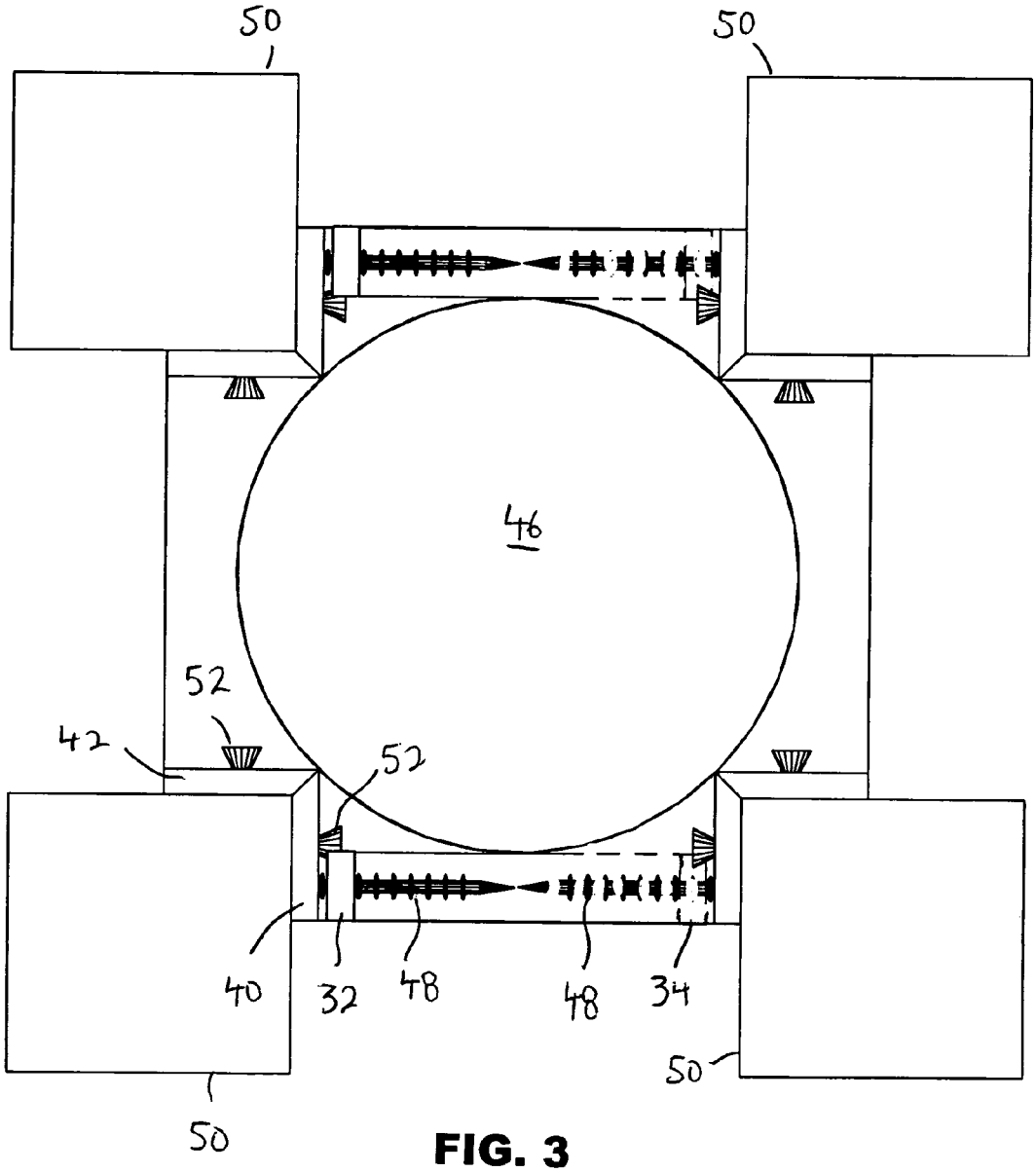
FIG. 3 is a top plan view of the arrangement of FIG. 2.
Figure 4:
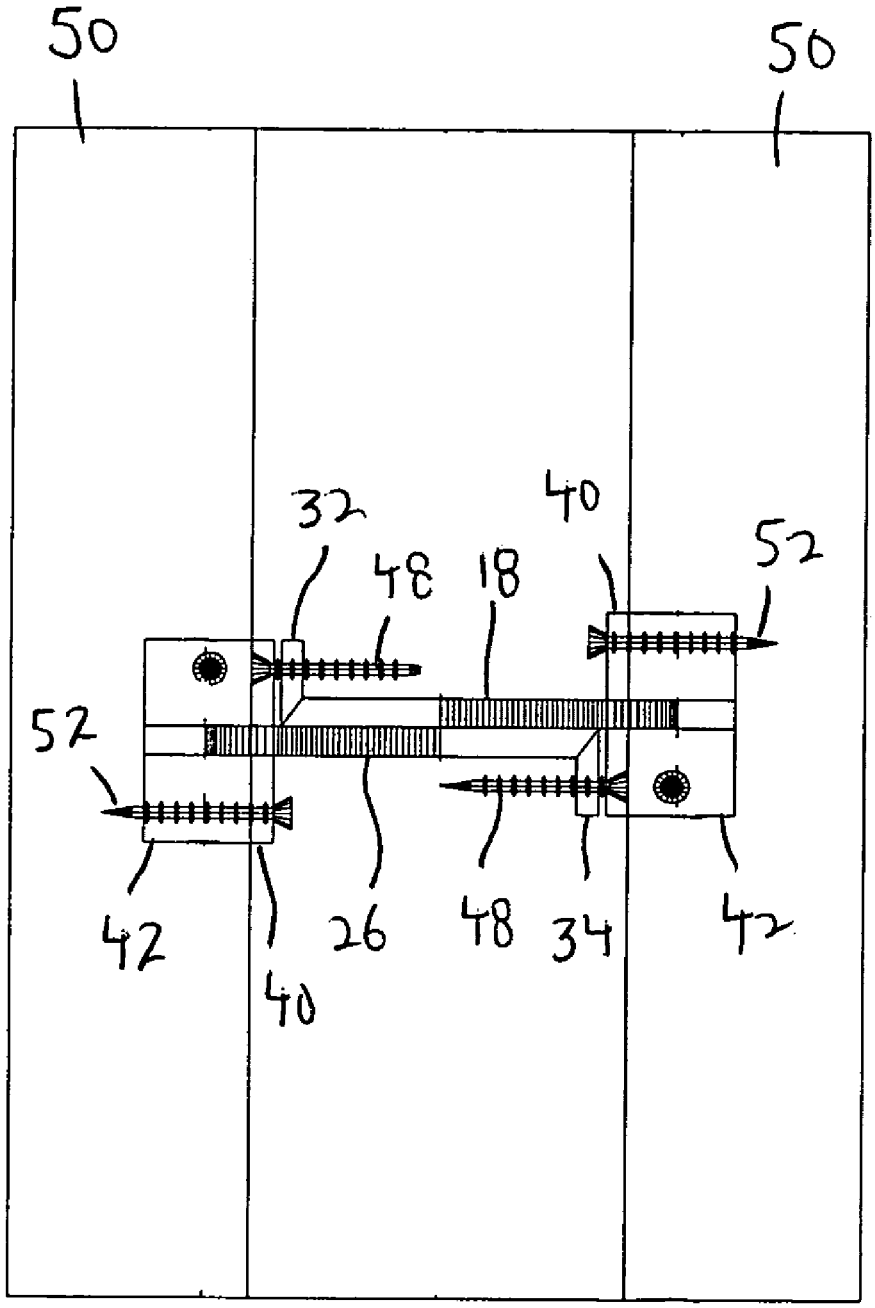
FIG. 4 is a front elevational view of the arrangement of FIG. 2.

Referring to the drawings in detail, and initially to FIGS. 1-4 thereof, an arrangement 10 for easily framing lolly columns according to a first embodiment of the present invention includes a first substantially U-shaped framing member 12 and a second substantially U-shaped framing member 14.

Framing member 12 is formed by a thin, plate-like center member 16 and two thin, plate-like legs 18 and 20 extending at right angles from the ends of the center member 16 and being in parallel, spaced apart relation. Center member 16 and legs 18 and 20 are coplanar and have a uniform thickness. The inner circumference formed by the inner facing walls of center member 16 and legs 18 and 20 defines a generally semi-circular wall 22 which staightens out toward the ends of the legs 18 and 20, while the outer circumference formed by the outer facing walls of center member 16 and legs 18 and 20 defines a generally square or rectangular shape.

In like manner, framing member 14 is formed by a thin, plate-like center member 24 and two thin, plate-like legs 26 and 28 extending at right angles from the ends of the center member 24 and being in parallel, spaced apart relation. Center member 24 and legs 26 and 28 are coplanar and have a uniform thickness. The inner circumference formed by the inner facing walls of center member 24 and legs 26 and 28 defines a generally semi-circular wall 30 which staightens out toward the ends of the legs 26 and 28, while the outer circumference formed by the outer facing walls of center member 24 and legs 26 and 28 defines a generally square or rectangular shape. The dimensions and shapes of framing members 12 and 14 are substantially mirror images of each other.

Legs 18 and 20 of framing member 12 each have an upwardly extending tab 32 at their free ends, while legs 26 and 28 of member 14 each have a downwardly extending tab 34 at their free ends. Each tab 32 and 34 has a hole 33 extending therethrough.

In accordance with an important aspect of the present invention, the corners 36, that is, where center member 16 and legs 18 and 20 meet and where center member 24 and legs 26 and 28 meet, are cut-out, and right angle walls 38 are secured in the cut-out corners 36. Right angle walls 38 are formed by a first rectangular wall 40 and a second rectangular wall 42 connected at an edge 44 at right angles to first wall 40 such that the right angle between walls 40 and 42 faces outwardly. The heights of walls 40 and 42 are the same and are much greater than the thickness of center members 16 and 24 and legs 18, 20, 26 and 28. The connection of center members 16 and 24 and legs 18, 20, 26 and 28 to walls 40 and 42 substantially bisects walls 40 and 42 along the height thereof so that center members 16 and 24 and legs 18, 20, 26 and 28 are centered as to walls 40 and 42, although the present invention is not limited thereto. In addition, although not limited thereto, the ends of walls 40 and 42 are substantially flush with the outer facing walls of center members 16 and 24 and legs 18, 20, 26 and 28 which form the generally square or rectangular shape. Each wall 40 and 42 has at least one hole 41 extending therethrough.

When framing members 12 and 14 are fit around a lolly column 46, legs 18 and 26 ride over and overlap each other and legs 20 and 28 ride over and overlap each other until tabs 32 and 34 abut against right angle walls 40 and are screwed thereinto by screws 48 in order to hold framing members 12 and 14 tightly together around lolly column 46. It will be appreciated that different size framing members 12 and 14 are provided with different internal diameters corresponding to different diameter lolly columns 46 such that, when assembled, inner semi-circular walls 22 and 30 are in contact with the outer surface of lolly column 46.

At this time, 2×2 inch, 2×4 inch, 2×6 inch, 4×4 inch, etc. wood, metal or plastic framing members 50 are arranged to fit within right angle walls 38 and are secured thereto by screws 52. In this manner, framing of a lolly column 46 is relatively straightforward and simple. Thereafter, paneling, sheet rock, etc. (not shown) is secured to framing members 50 by screws or nails, as is conventional.

Figure 5:
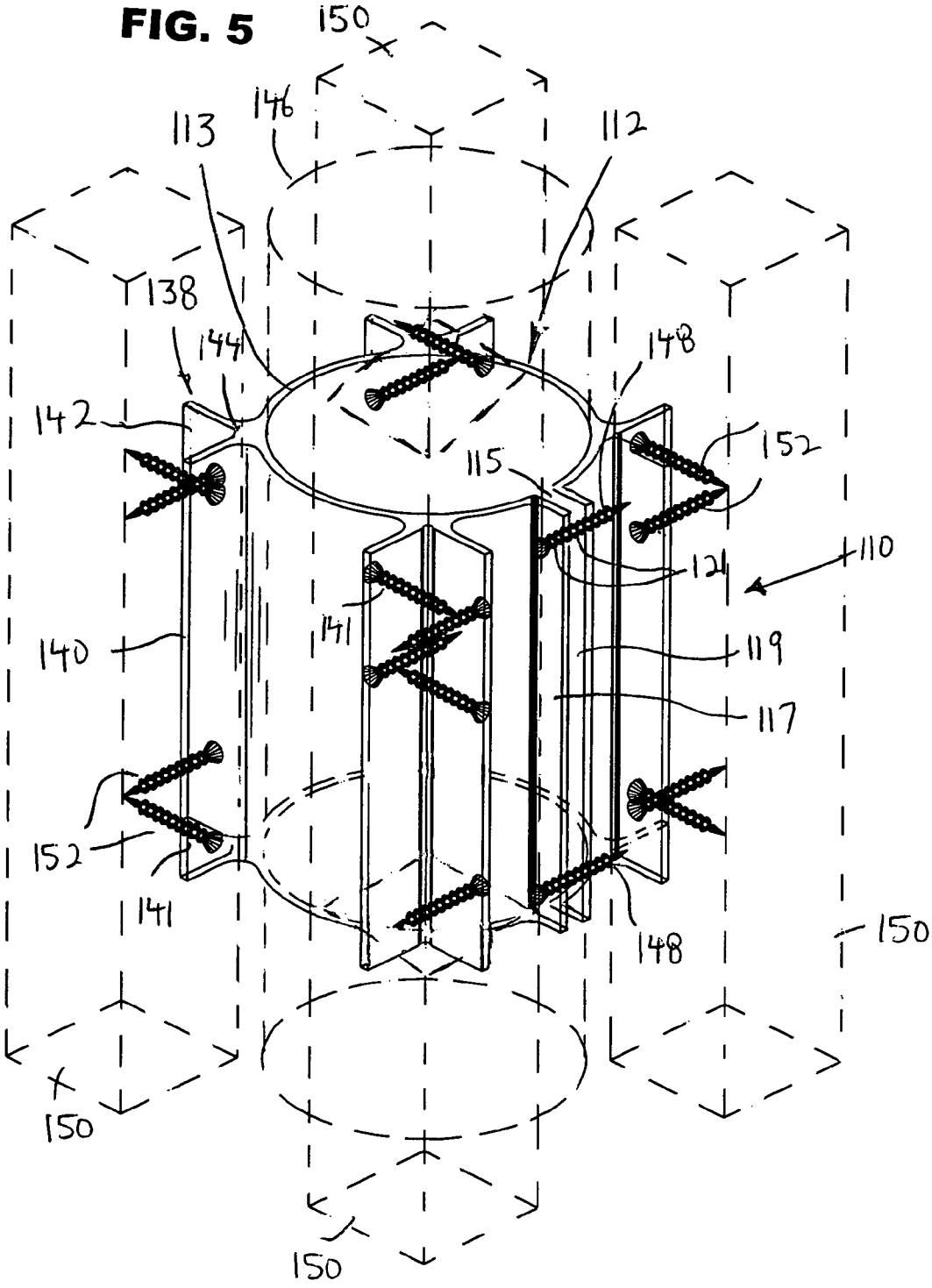
FIG. 5 is an assembled perspective view of an arrangement for easily framing lolly columns according to a second embodiment of the present invention, with the 4×4 inch wood framing members and the lolly column shown in phantom.
Figure 6:
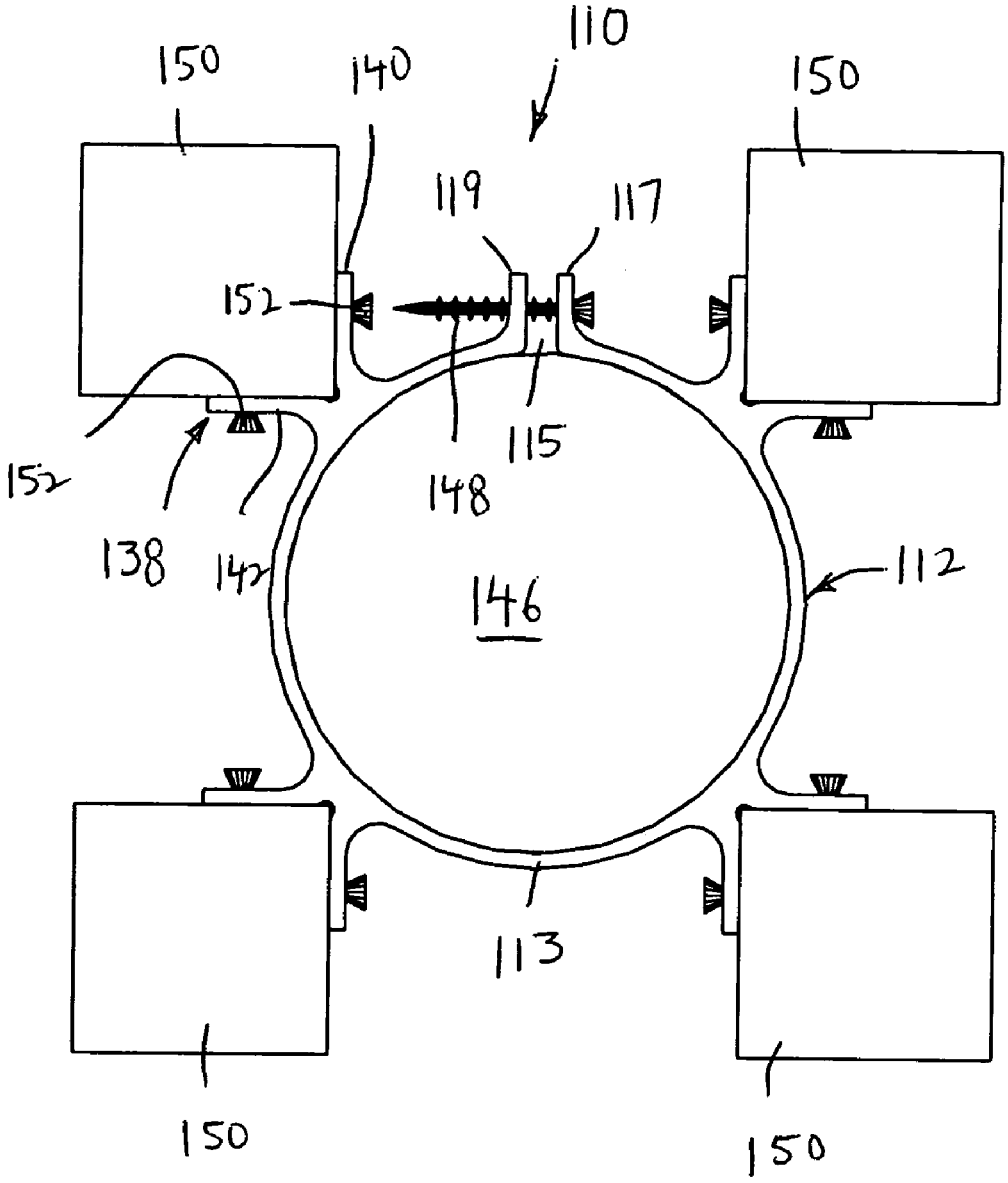
FIG. 6 is a top plan view of the arrangement of FIG. 5.
Figure 7:
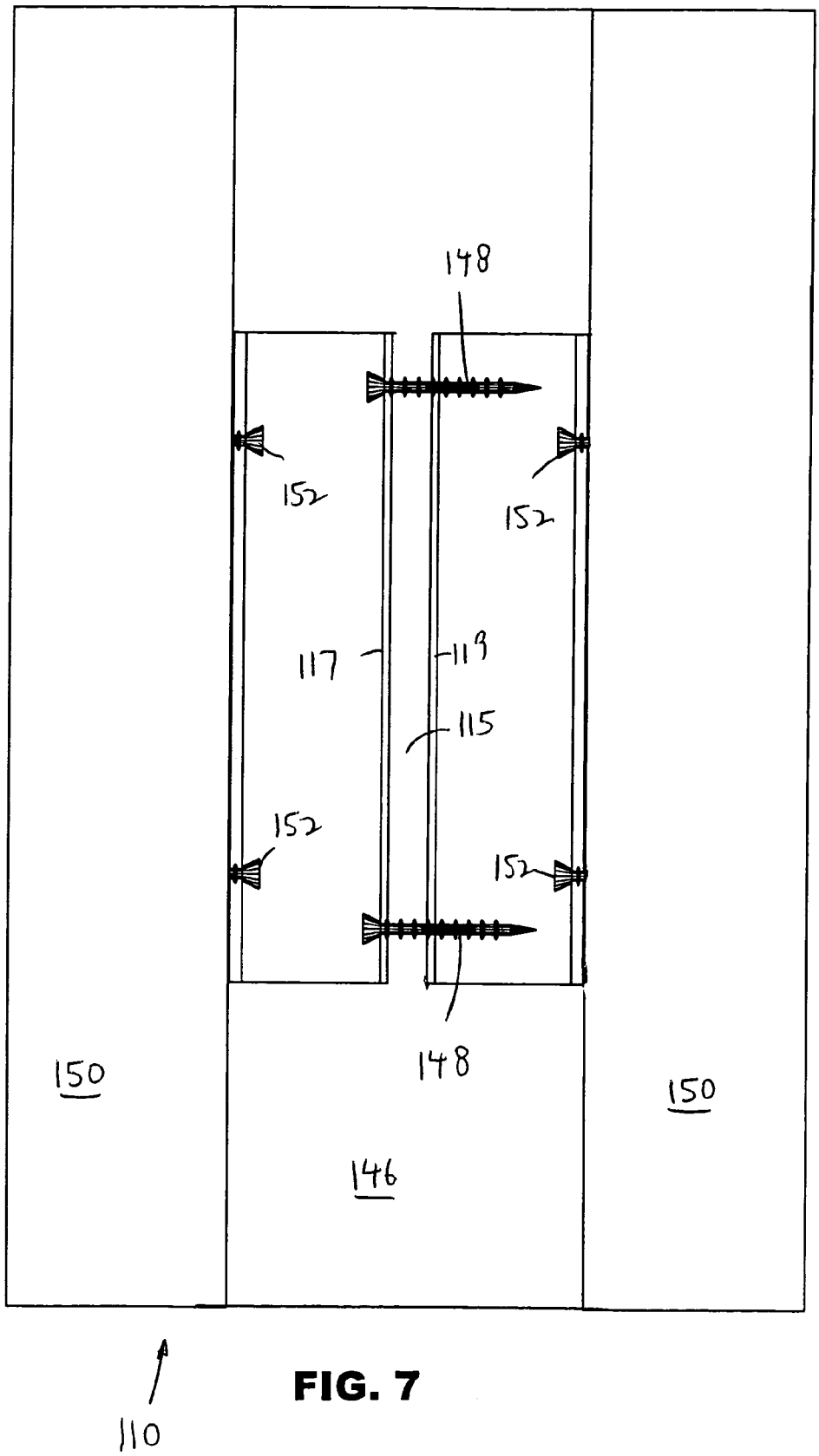
FIG. 7 is a front elevational view of the arrangement of FIG. 5.

Referring now to FIGS. 5-7, there is a shown an arrangement 110 for easily framing lolly columns according to a second embodiment of the present invention. In the second embodiment, rather than providing two U-shaped framing members 12 and 14, arrangement 110 includes a hollow, substantially cylindrical member 112 defined by a thin, substantially annular wall 113 of uniform thickness which fits around the lolly column 146. Cylindrical member 112 includes a lengthwise slot 115 and the ends of which are provided with lengthwise extending flanges 117 and 119 which, when positioned around lolly column 146, are in facing or substantially abutting relation and can be held together by screws 148. It will be appreciated that, although flanges 117 and 119 are shown extending the entire length of cylindrical member 112, the present invention is not limited thereto, and flanges 117 and 119 can extend less than the entire length of cylindrical member 112. It is merely necessary to pull flanges 117 and 119 apart in order to position cylindrical member 112 around lolly column 146, and when positioned therearound, the resiliency of cylindrical member 112 will force flanges 117 and 119 back into substantial contact with each other. Flanges 117 and 119 have aligned holes 121 extending therethrough.

Arrangement 110 also includes four equi-angularly spaced right angle walls 138 around the outer circumference of cylindrical member 112 for receiving framing members 150. Thus, right angle walls 138 are equi-angularly spaced apart by 90° around the lolly column. Right angle walls 138 are each formed by a first rectangular wall 140 and a second rectangular wall 142 connected at an edge 144 at right angles to first wall 140 such that the right angle between walls 140 and 142 faces outwardly. The heights of walls 140 and 142 are the same as the height of cylindrical member 112, although the present invention is not limited thereto. Each wall 140 and 142 has at least one hole 141 extending therethrough.

In operation, it is only necessary to pull apart and separate flanges 117 and 119, and then position cylindrical member 112 around lolly column 146. Due to the resilience of cylindrical member 112, the ends which contain flanges 117 and 119 will spring back toward each other once placed around lolly column 146. It will be appreciated that different size cylindrical members 112 are provided with different internal diameters corresponding to different diameter lolly columns 146 such that, when assembled, the inner cylindrical wall surface of cylindrical wall 112 is in contact with the outer surface of lolly column 146. Thereafter, screws 148 are inserted through flanges 117 and 119 to tightly secure cylindrical wall 112 around lolly column 146. It will be appreciated that arrangement 110 provides the additional advantage that it is adaptable to different size lolly columns 146 by tightening flanges 117 and 119 toward each other to a greater or lesser extent.

At this time, framing members 150 are arranged to fit within right angle walls 138 and are secured thereto by screws 152. In this manner, framing of a lolly column 146 is relatively straightforward and simple. Thereafter, paneling, sheet rock, etc. (not shown) is secured to framing members 150 by screws or nails, as is conventional.

It will be appreciated that various modifications can be made to the present invention within the scope of the claims. For example, it is possible that walls 42, 142 can be eliminated. In such case, although it would not be as secure an arrangement, the framing members 50, 150 would be connected only to walls 40, 140, respectively.

It will also be appreciated that right angle walls 38, 138 can be formed separately from and then be secured to framing members 12, 14 and cylindrical member 112, respectively, or they can be formed integrally as one-piece therewith in a molding operation.

It will be appreciated that different size framing member 50, 150 can be fit around the same lolly column 46, 146, for example, to move sheet rock or paneling out, in order to meet other walls or structures, such as soffits, ceilings, etc.

It will also be appreciated that corner beads commonly provided at the corners of sheet rock can now be positively secured to the framing members at any length and any interval.

It will further be appreciated that all four corners need not be utilized. For example, only one corner can be used to form a right angle for a wall to be formed, for example, when dividing an area into separate rooms.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. An arrangement for easily framing a lolly column, comprising:

at least one securing member adapted to be wrapped and secured tightly about a lolly column when the lolly column is fixed at a lower end thereof to a floor and at an upper end thereof to a ceiling, each said securing member including a substantially hollow, thin walled cylindrical member having a lengthwise slot extending therealong which splits the cylindrical member along the length thereof to define opposite facing edges on opposite sides of said lengthwise slot that are movable away from each other to enable the opposite facing edges to be pulled apart to permit the cylindrical member to be pulled in a direction transverse to a lengthwise direction thereof around a lolly column and thereby wrap the cylindrical member around the lolly column; and a plurality of wall members secured to the at least one securing member for securing elongated framing members thereto such that the framing members extend in a direction parallel to the lolly column, each wall member including a first wall presenting a planar surface to which an elongated framing member is adapted to be secured, wherein each wall member includes a second wall presenting a planar surface to which the elongated framing member is adapted to be secured, the second wall being connected with at least one of said first wall and said cylindrical member at a position substantially at a connection of said first wall to said cylindrical member, and said first and second walls of each wall member substantially form a right angle therebetween.

2. An arrangement according to claim 1, wherein each wall of the wall member includes an opening for receiving a fastening member therethrough for securement of the framing member.

3. An arrangement according to claim 1, wherein at least one said securing member includes lengthwise extending flanges extending along the facing edges of said cylindrical member on opposite sides of said lengthwise slot in facing relation to each other.

4. An arrangement according to claim 3, wherein each lengthwise extending flange extends along an entire length of said cylindrical member.

5. An arrangement according to claim 3, wherein said wall members each extend along an entire length of said cylindrical member.

6. An arrangement according to claim 3, further comprising a securing arrangement for securing together said lengthwise extending flanges so as to secure said cylindrical member around said lolly column.

7. An arrangement according to claim 3, wherein each of said lengthwise extending flanges includes an opening for receiving a fastening member therethrough for securement of said lengthwise extending flanges to each other in order to tighten the cylindrical member around the lolly column.

8. An arrangement for easily framing a lolly column, comprising:

at least one securing member adapted to be wrapped and secured tightly about a lolly column when the lolly column is fixed at a lower end thereof to a floor and at an upper end thereof to a ceiling, each said securing member including a substantially hollow, thin walled cylindrical member having a lengthwise slot extending therealong which splits the cylindrical member along the length thereof to define opposite facing edges on opposite sides of said lengthwise slot that are movable away from each other to enable the opposite facing edges to be pulled apart to permit the cylindrical member to be pulled in a direction transverse to a lengthwise direction thereof around a lolly column and thereby wrap the cylindrical member around the lolly column; and a plurality of wall members secured to the at least one securing member for securing elongated framing members thereto such that the framing members extend in a direction parallel to the lolly column, each wall member including a first wall presenting a planar surface to which an elongated framing member is adapted to be secured, wherein at least one said securing member includes lengthwise extending flanges extending along the facing edges of said cylindrical member on opposite sides of said lengthwise slot in facing relation to each other, wherein there are four equi-angularly spaced wall members secured to an outer surface of said cylindrical member, wherein each wall member includes a second wall presenting a planar surface to which the elongated framing member is adapted to be secured, the second wall being connected with at least one of said first wall and said cylindrical member at a position substantially at a connection of said first wall to said cylindrical member.

9. An arrangement for easily framing a lolly column, comprising:

at least one securing member adapted to be wrapped and secured tightly about a lolly column when the lolly column is fixed at a lower end thereof to a floor and at an upper end thereof to a ceiling, each said securing member including a substantially hollow, thin walled cylindrical member having a lengthwise slot extending therealong which splits the cylindrical member along the length thereof to define opposite facing edges on opposite sides of said lengthwise slot that are movable away from each other to enable the opposite facing edges to be pulled apart to permit the cylindrical member to be pulled in a direction transverse to a lengthwise direction thereof around a lolly column and thereby wrap the cylindrical member around the lolly column;

a plurality of wall members secured to the at least one securing member for securing elongated framing members thereto such that the framing members extend in a direction parallel to the lolly column, each wall member including a first wall presenting a planar surface to which an elongated framing member is adapted to be secured, wherein at least one said securing member includes lengthwise extending flanges extending along the facing edges of said cylindrical member on opposite sides of said lengthwise slot in facing relation to each other, and wherein each wall member includes a second wall presenting a planar surface to which the elongated framing member is adapted to be secured, the second wall being connected with at least one of said first wall and said cylindrical member at a position substantially at a connection of said first wall to said cylindrical member.

10. An arrangement according to claim 9, wherein said first and second walls of each wall member substantially form a right angle therebetween.

11. An arrangement according to claim 9, wherein each wall of the wall member includes an opening for receiving a fastening member therethrough for securement of the framing member.

12. An arrangement according to claim 9, wherein there are four sets of first and second walls equi-angularly spaced apart by 90° around the lolly column.

* * * * *